US006152762A

United States Patent [19]

Marshall et al.

[11] Patent Number: 6,152,762

[45] Date of Patent: Nov. 28, 2000

[54] MODULAR JACK WITH SIDE MOUNTED LIGHT EMITTING DIODE

[75] Inventors: Robert E. Marshall, Elizabethtown, Pa.; Gary J. Oleynick, Encinitas, Calif.; Bonita L. Wheeler, Red Lion, Pa.

[73] Assignee: Berg Technology, Inc., Reno, Nev.

[21] Appl. No.: 09/191,427

[22] Filed: Nov. 12, 1998

[51] Int. Cl.[7] ..... H01R 3/00

[52] U.S. Cl. ..... 439/489; 439/490; 439/676

[58] Field of Search ..... 439/489, 490, 439/607, 608, 609, 610, 676, 83

[56] References Cited

U.S. PATENT DOCUMENTS

| | | | |
|---|---|---|---|
| 4,379,606 | 4/1983 | Clark et al. | 339/17 CF |
| 4,978,317 | 12/1990 | Pocrass | 439/490 |
| 4,990,108 | 2/1991 | Sakaguchi | 439/678 |
| 5,601,451 | 2/1997 | Driones et al. | 439/490 |
| 5,613,873 | 3/1997 | Bell, Jr. et al. | 439/490 |
| 5,685,737 | 11/1997 | Mortin et al. | 439/490 |
| 5,700,157 | 12/1997 | Chung | 439/490 |
| 5,704,802 | 1/1998 | Loudermilk | 439/490 |
| 5,797,767 | 8/1998 | Schell | 439/490 |
| 5,876,240 | 3/1999 | Derstine et al. . | |
| 5,885,100 | 3/1999 | Talend et al. | 439/490 |
| 5,924,889 | 7/1999 | Wang | 439/490 |
| 5,924,890 | 7/1999 | Morin et al. . | |
| 5,975,943 | 11/1999 | Chou et al. . | |

FOREIGN PATENT DOCUMENTS

| | | | |
|---|---|---|---|
| 0 740 370 A1 | 10/1996 | European Pat. Off. | 13/717 |

*Primary Examiner*—Paula Bradley
*Assistant Examiner*—Alexander Gilman
*Attorney, Agent, or Firm*—Brian J. Hamilla; M. Richard Page

[57] ABSTRACT

A modular jack comprising an insulative housing having a substantially open front side and a rear side and first and second longitudinal walls. The second longitudinal wall is positioned over said first longitudinal wall in spaced parallel wall. A pair of lateral walls interposed in spaced parallel relation between said first and second longitudinal walls to form at least one transverse plug receiving cavity extending from the substantially open front side of said jack to the rear side. A light emitting diode (LED) module is fixed to one of said lateral sides of the housing to allow for easy visibility and reduced interference with signals to the jack. The LED module is also easily removable to allow field replacement.

39 Claims, 9 Drawing Sheets

MODULAR JACK WITH SIDE MOUNTED LIGHT EMITTING DIODE

BACKGROUND OF THE INVENTION

1. Field of the Invention

The present invention relates to electrical connectors and more particularly to modular jacks which incorporate a light emitting diode.

2. Brief Description of Earlier Developments

The use of a light emitting diode (LED) in a modular jack is well known in the art. The LED indicates that a signal is being received at the jack and is useful, for example, in trouble shooting a communications fault.

A number of arrangements for positioning the LED and the modular jack are suggested by the prior art. For example, in certain arrangements the LED is positioned inside the metallic shield and often below the body of the modular jack. The disadvantage of such an arrangement is that noise from the LED may tend to interfere with the signals to the jack.

Another arrangement which is disclosed by the prior art is one in which the LED is positioned on top of the jack. While such an arrangement may result in somewhat less interference with signals to the jack than one in which the jack is positioned above the LED, such interference may still result. Further, when a plurality of jacks are stacked one over the other in a gang jack, cables which are connected to the upper jacks may obscure the LED's on the lower jacks.

Another drawback to the prior art arrangement is that many LED's which are conventionally used with modular jacks are positioned in a cored out portion of the insulative housing of the jack. The replacement of such LED's can often be expensive and time consuming. Consequently, the intire jack is often disposed of in the event of the failure of the LED.

A need, therefore, exists for a modular jack with an LED in which noise from the LED does not tend to interfere with ksignals to the jack and in which the LED is not obscured by cables in a stacked modular jack configuration. A further need exists for a modular jack in which LED's which are used with the jack are quickly and easily replaceable in hte event of the failure of an LED. In particular, a need exists for a modular jack in which the LED is field repaceable by the user of the jack.

SUMMARY OF THE INVENTION

The present invention is a modular jack comprising an insulative housing having a substantially open front side and a rear side and first and second longitudinal walls. The second longitudinal walll is positioned over said first longitudinal wall in spaced parallel krelation. A pair of spaced parallel lateral walls is interposed between said first and second longitudinal walls to form at least one plug receiving cavity extending from the substantially open front side of said jack to the rear side. Conductive means extend first adjacent the rear side of the housing from the first to the second longitudinal wall and then toward the front side adjacent the second longitudinal wall and then obliquely in the plug receiving cavity toward the rear wall. A light emitting diode is fixed to one of said lateral sides of the housing.

Also encompassed by the present invention is an LED module which is adapted to be removably mounted on a modular jack. The module includes an insulative housing having at least one LED receiving recess, an LED positioned in the recess and means for fixing the LED module to a modular jack.

BRIEF DESCRIPTION OF THE DRAWINGS

The invention is further described with reference to the accompanying drawings in which.

DETAILED DESCRIPTION OF THE PREFERRED EMBODIMENTS

Figure 2:
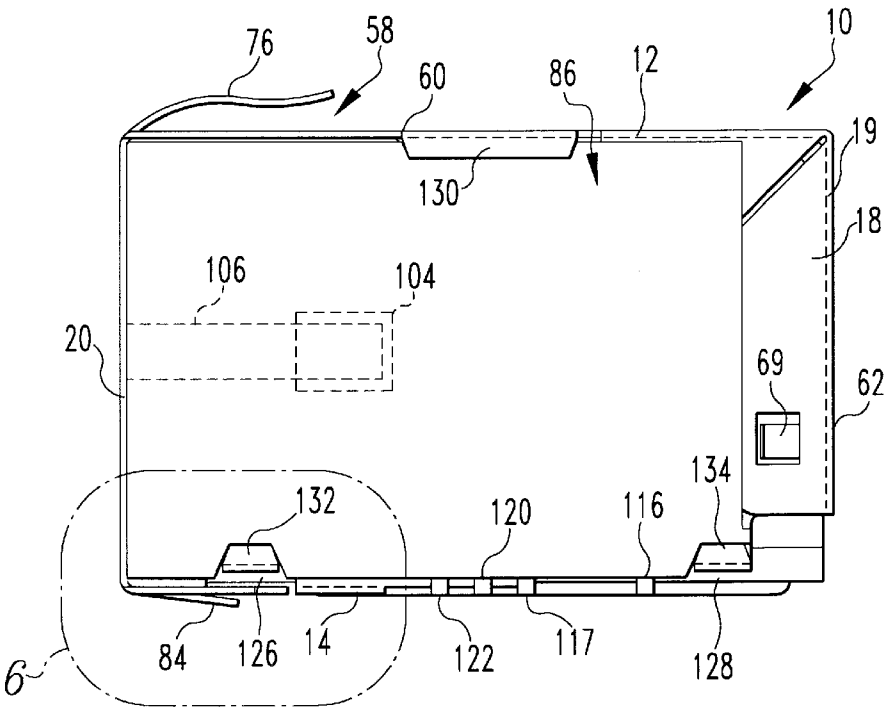
FIG. 2 is a side elevational view of the modular jack shown in FIG. 1.
Figure 1:
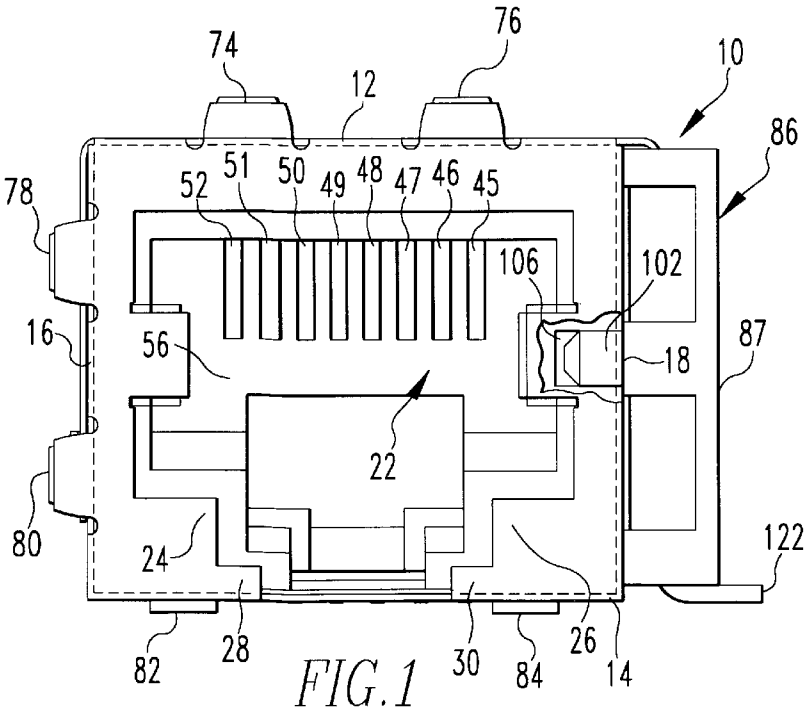
FIG. 1 is a partially cut away front elevational view of the preferred embodiment of the modular jack of the present invention.
Figure 3:
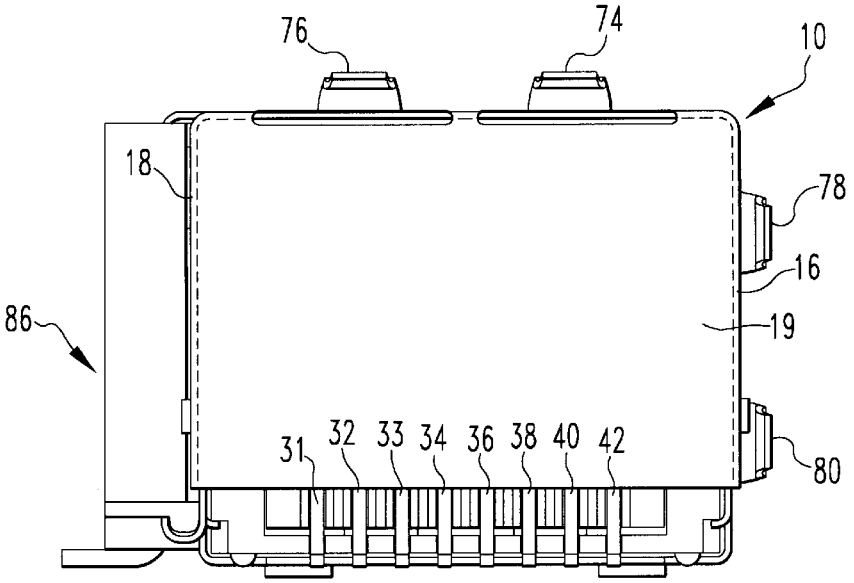
FIG. 3 is a rear elevational view of the modular jack shown in FIG. 1.
Figure 4:
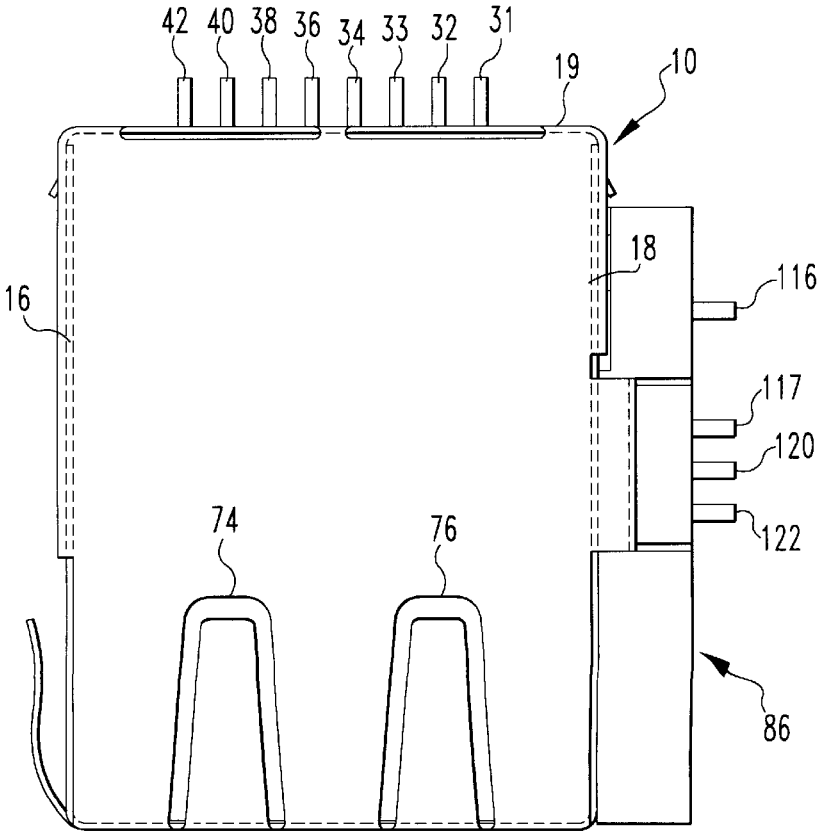
FIG. 4 is a top plan view of the modular jack shown in FIG. 1.
Figure 5:
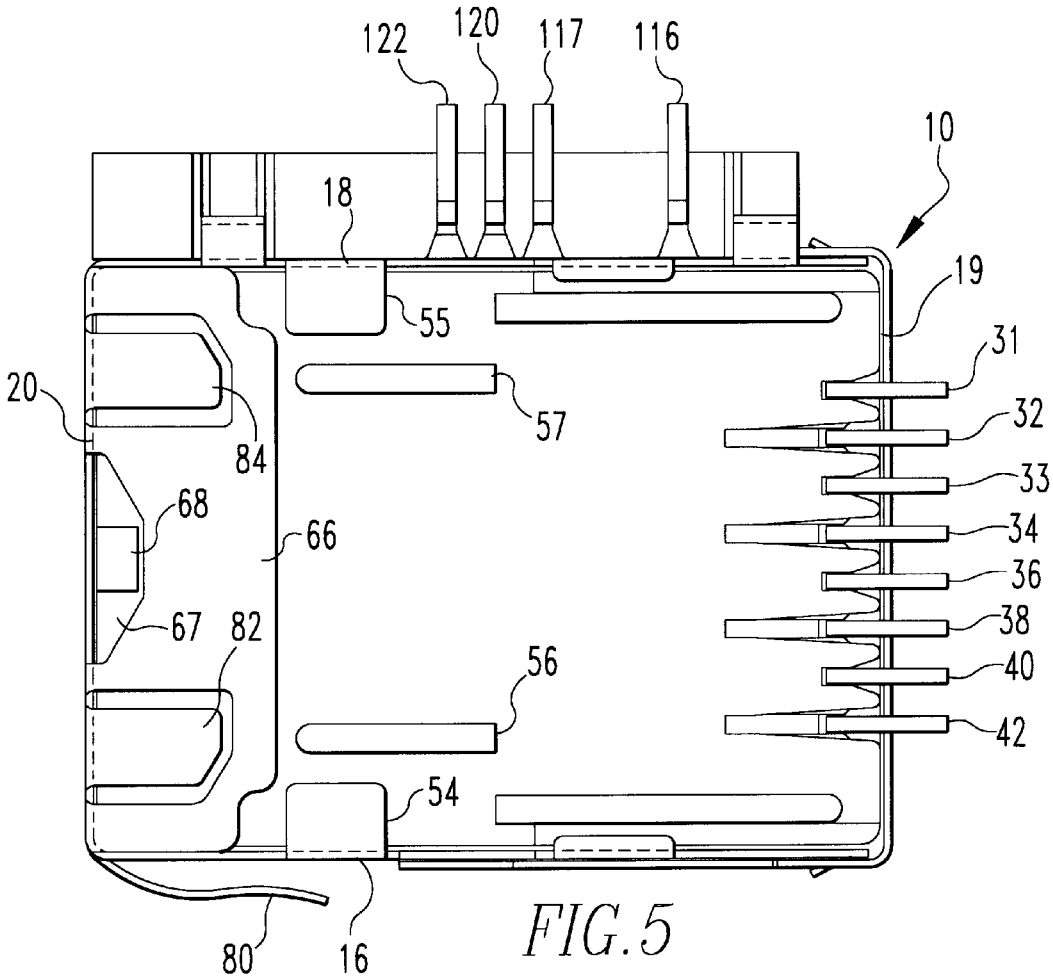
FIG. 5 is a bottom plan view of the modular jack shown in FIG. 1.
Figure 6:
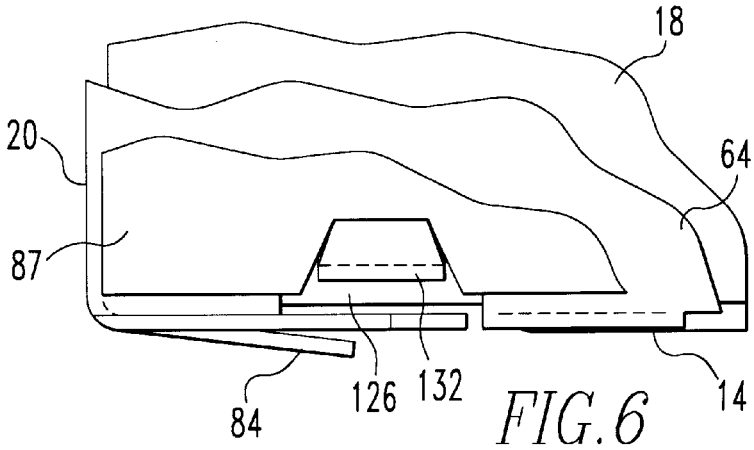
FIG. 6 is a partially cut away enlarged view of area 6 in FIG. 2.

Referring to FIGS. 1–6, the modular jack is shown generally at numeral 10 which has a top wall 12, a bottom wall 14, and lateral walls 16 and 18 and a rear wall 19 as is conventional. The modular jack has an open front side 20 with an insert receiving cavity 22. Beneath the insert receiving cavity there is an upper set of steps 24 and 26 and a lower set of opposed steps 28 and 30. Adjacent the rear wall of the modular jack there are terminals 31, 32, 33, 34, 36, 38, 40 and 42 which are adapted for surface mount (SMT) on a printed circuit board (PCB) (not shown). These terminals extend upwardly adjacent the rear wall and then in a forward direction adjacent the top wall and extend through the top wall and obliquely downwardly and rearwardly in the insert receiving cavity in contacts 45, 46, 47, 48, 49, 50, 51 and 52 toward interior medial wall 53. As is conventional, the jack also includes solder pads 54 and 55 and stand offs 56 and 57.

Figure 11:
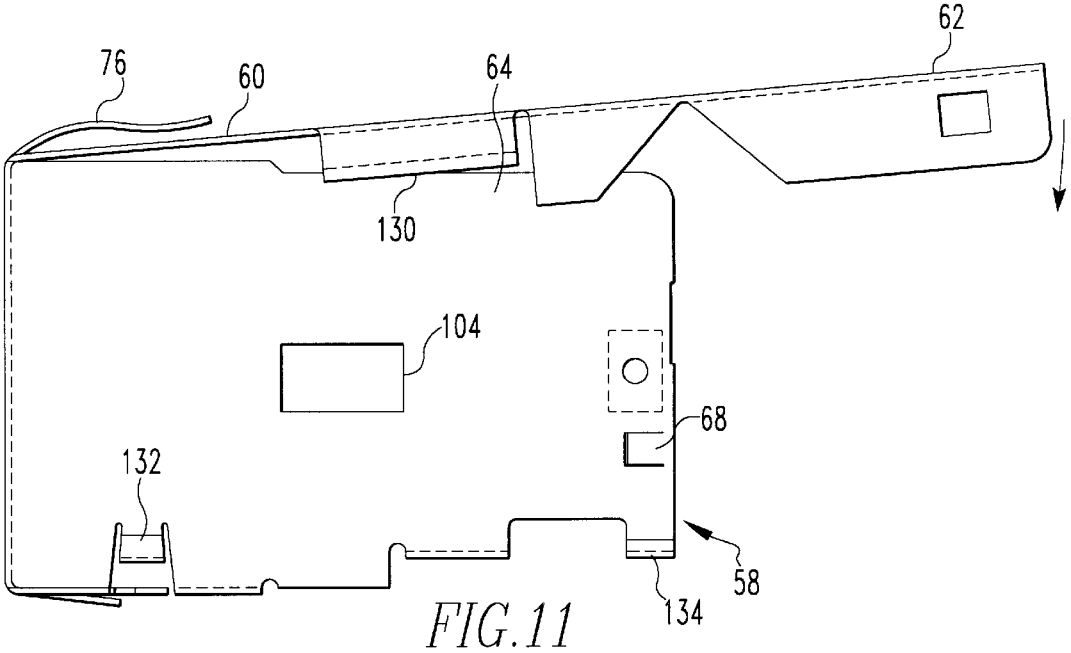
FIG. 11 is a front elevational view of the metallic shield in the modular jack shown in FIG. 1.
Figure 12:
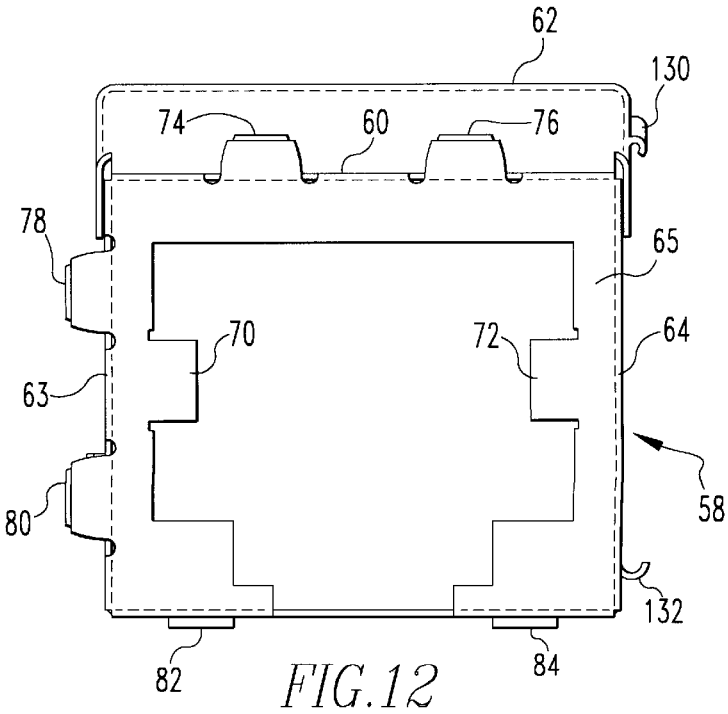
FIG. 12 is a side elevational view of the metallic shield shown in FIG. 11.
Figure 13:
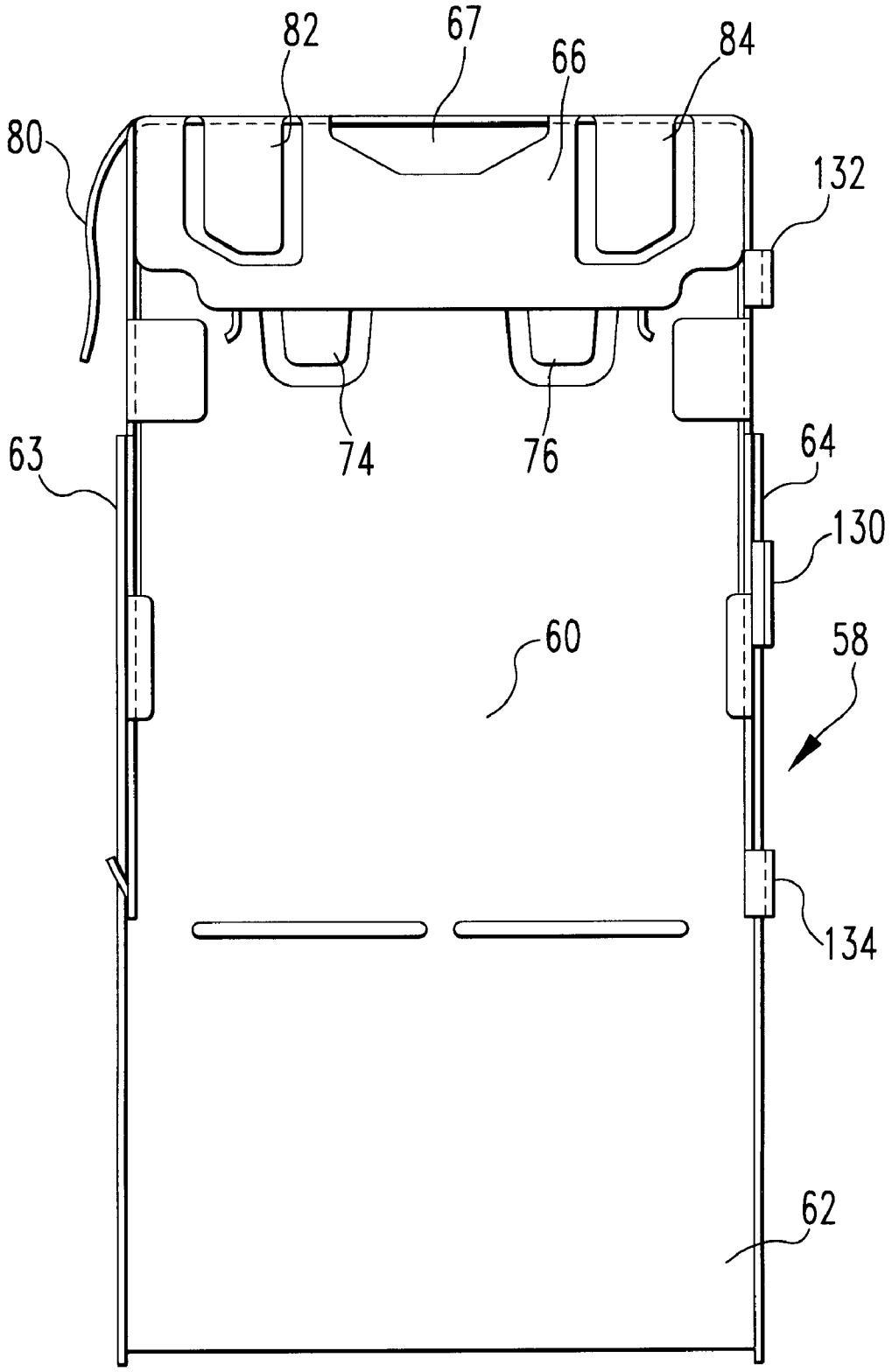
FIG. 13 is a bottom plan view of the metallic shield shown in FIG. 11.

Referring to FIGS. 1–6 and 11–13, a metallic shield covering the modular jack 10 is shown generally at numeral 58. This shield includes a top section 60, a rear section 62 and side sections 63 and 64. The shield also includes a front face section 65 with a bottom extension 66 that has an opening 67 which engages a raised feature 68 on the housing. The top section 60 is bent downwardly in the direction of the arrow in FIG. 11 to engage the side section 64 by means of latching projections as at projection 69. The shield is also attached to the insulative modular jack by means of front medial clips 70 and 72. For engagement to exterior surfaces on, for example, a panel (not shown) the metallic shield also has a pair of upper clips 74 and 76, lateral clips 78 and 80 and bottom clips 82 and 84.

Figure 7:
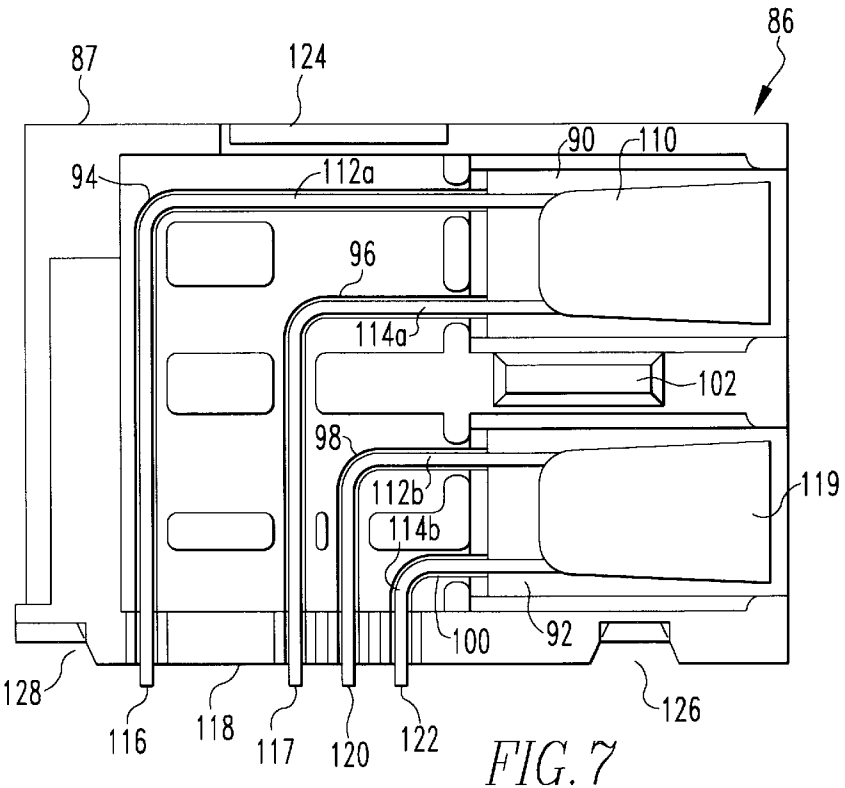
FIG. 7 is a side elevational view of the LED module shown in FIG. 1.
Figure 8:
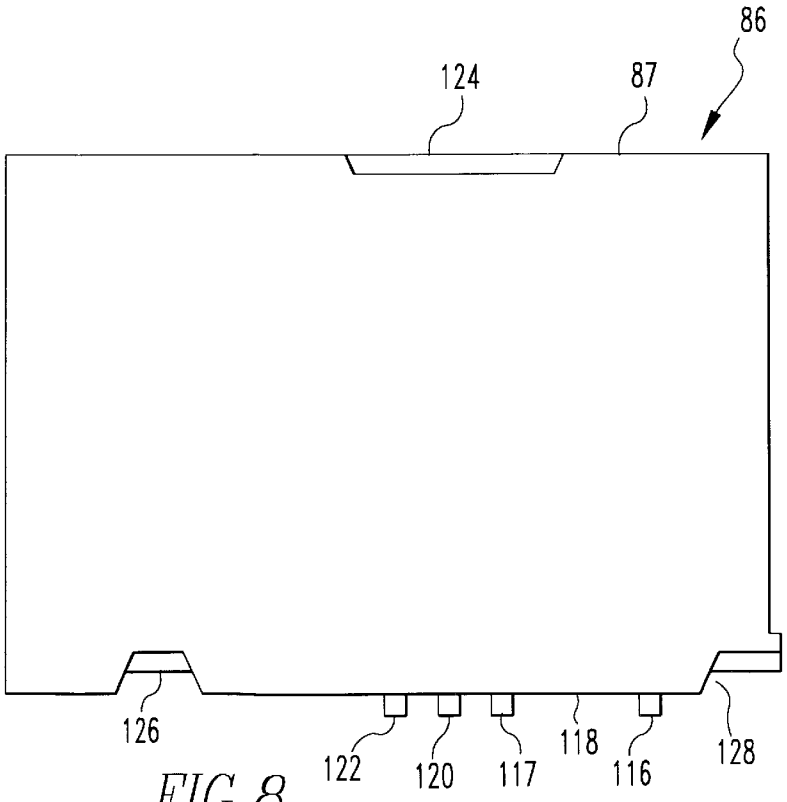
FIG. 8 is an opposed side elevational view of the LED module shown in FIG. 7.
Figure 9:
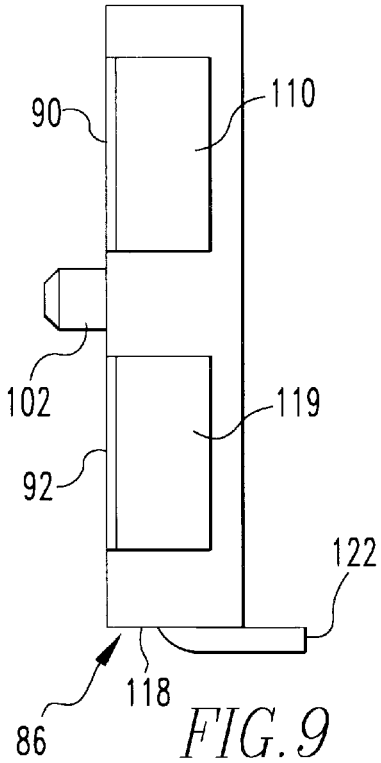
FIG. 9 is a front elevational view of the LED module shown in FIG. 7.
Figure 10:
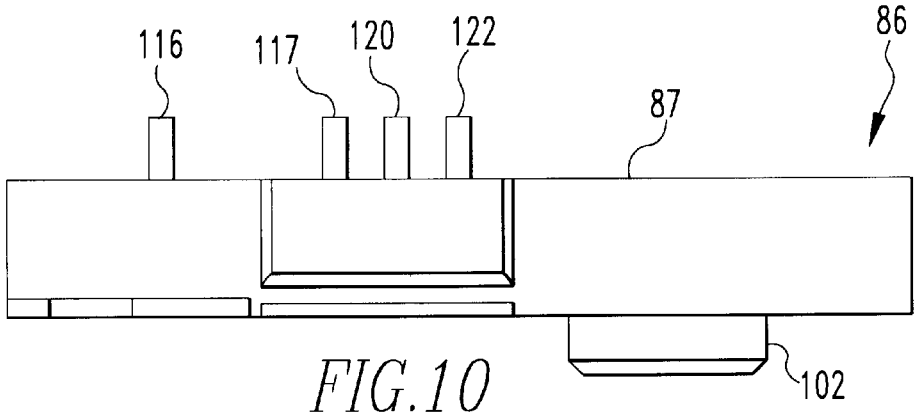
FIG. 10 is a top plan view of the LED module shown in FIG. 7.

The LED module and related features on the housing and shield are shown in FIGS. 1–2 and 6–11. The LED module used on the jack 10 is shown generally at numeral 86. This LED module includes an insulative housing 87 which has a pair of LED receiving recesses 90 and 92. Extending from recess 92 there is a pair of wire conveying channels 94 and 96. Extending from recess 92 there is a pair of wire conveying channels 98 and 100. An attachment pin 102 extends through an aperture 104 in the shield to engage a recess 106 in the side wall of the modular jack 10. A top LED 110 is positioned in recess 92 and wires 112 and 114*a* extend from LED 110 in channels 94 and 96 respectively to SMT terminals 116 and 117 at the base 118 of the LED module. Wires 112*b* and 114*b* extend from LED 119 in recess 92 in channels 98 and 100 respectively to form SMT terminals 120 and 122. The LED's may be the same or different colors. The top LED 110 may, for example, indicate system operation module and the lower LED 119 may indicate the transmission of a signal to the modular jack 10. It will also be understood that the recesses 90 and 92 are open at both the side and edge of the housing to allow LED's 110 and 111 to be visible from the front of the jack 10. The LED insulative housing 88 also includes an upper attachment recess 124 and lower attachment recesses 126 and 128. These recesses are engaged respectively by an upper attachment shield projection 130 and lower attachment shield projections 132 and 134 to retain the LED module adjacent the modular jack.

It will be appreciated that the above described feature result in a number of different forces which contribute to fixing the LED module to the modular jack 10. First, there is an interference fit between the pin 102 and the slot 106 in the lateral wall 18 of the insulative housing of the modular jack. Further, the aperture 104 in the shield 86 is preferably sized so that on at least one of its sides the shield 86 will abut the pin 102 thus creating additional resistance to the removal of the pin 106 from slot 104. Finally, recesses 124, 126 and 128 in the insulative housing 87 of LED module 86 are respectively engaged by hooks 130, 132 and 134 to further contribute to the forces fixing the LED module 86 to the modular jack 10. It will also be understood that the LED module 86 can be quickly and easily removed and replaced in the field or elsewhere by disengaging the hooks 130, 132 and 134 respectively from recesses 124, 126 and 128 and removing pin 102 from slot 106 and aperture 104. Ordinarily hook 130 would be removed from recess 124 by application of pressure on it with a screw driver or the like. The LED module 86 would then be outwardly pivoted on hooks 132 and 134 after which the LED module would be removed. By reversing this procedure a new LED module can quickly and easily be fixed to the modular jack 10.

To insert a new module recess 126 and 128 would be positioned on hooks 132 and 134 and the LED module would be pivoted inwardly and hook 130 snapped into recess 124.

Figure 16:
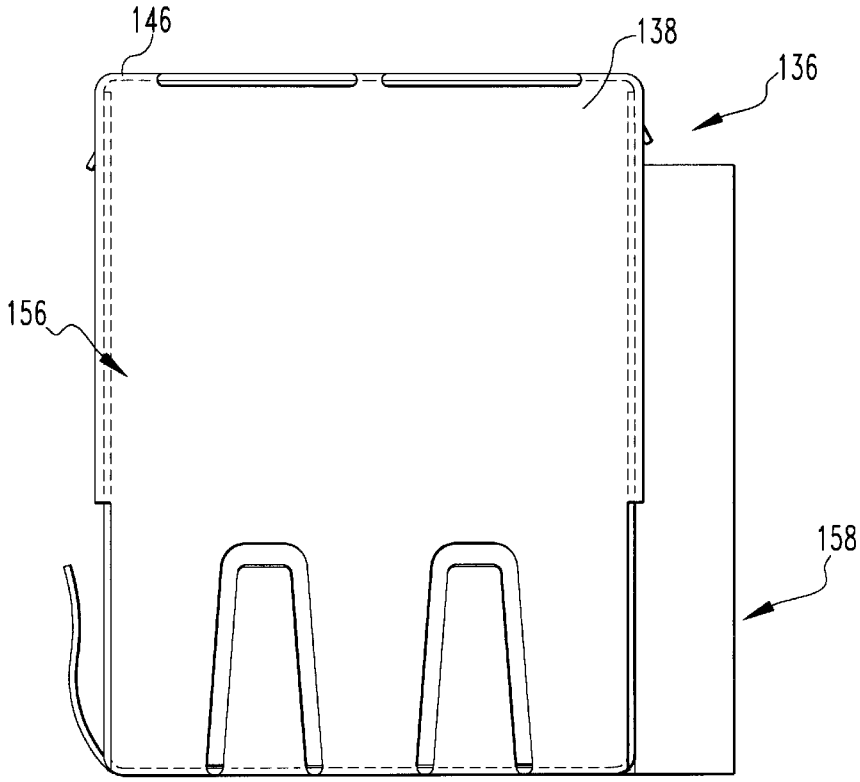
FIG. 16 is a top plan view of the modular jack shown in FIG. 14.
Figure 14:
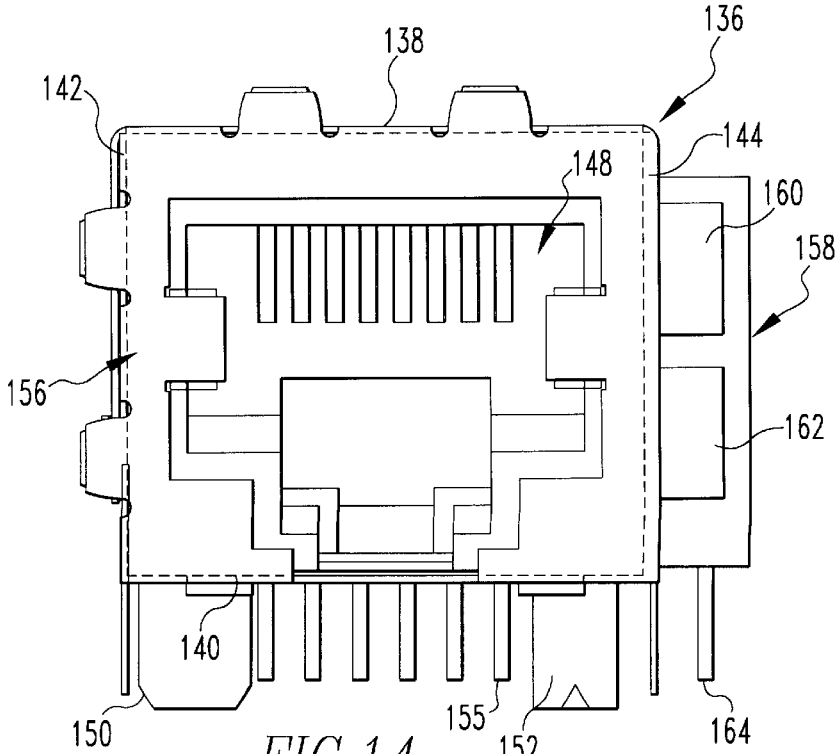
FIG. 14 is a front elevational view of a second preferred embodiment of the modular jack of the present invention.
Figure 15:
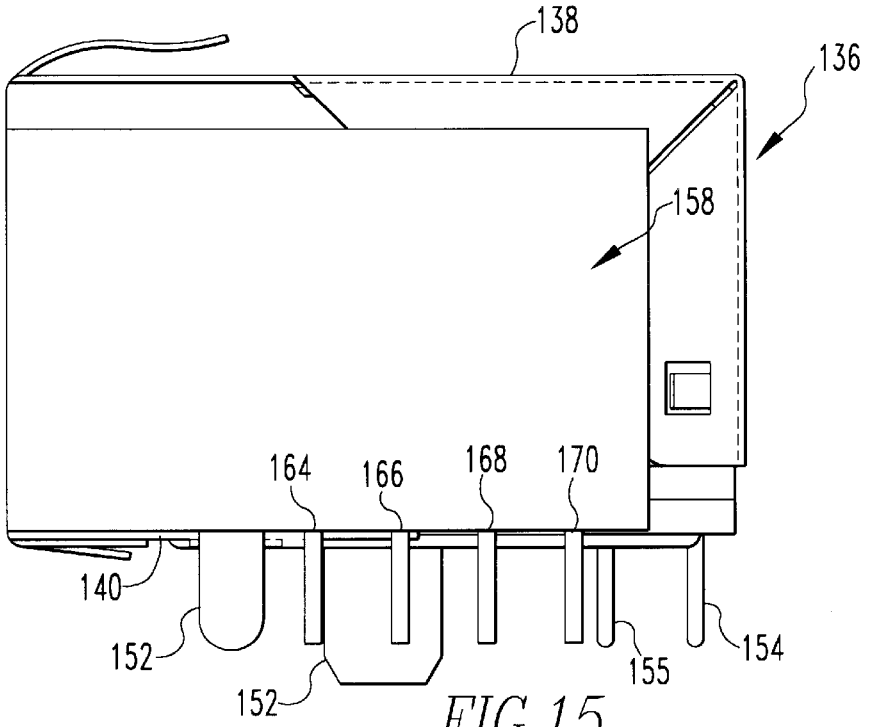
FIG. 15 is a side elevational view of the modular jack shown in FIG. 15.
Figure 17:
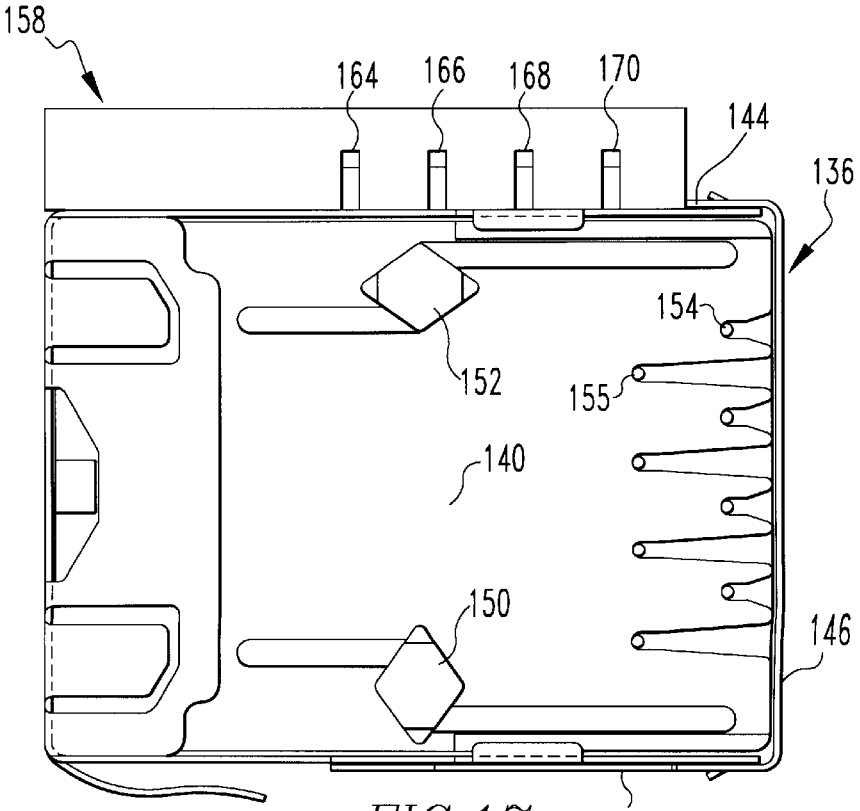
FIG. 17 is a bottom plan view of the modular jack shown in FIG. 14.

Referring to FIGS. 14–17, another embodiment of the modular jack is shown generally at numeral 136. This embodiment is adapted for through mount on a PCB, and includes a top wall 138, a bottom wall 140, lateral walls 142 and 144 and a rear wall 146. In opposed relation to the rear wall 146 there is a front opening 148. Extending downwardly from the rear wall there are engagement pins 150 and 152 for mounting on a PCB which feature is not shown in the first embodiment. This embodiment also includes a plurality of contacts as at contact 154 and 155 and a metallic shell 156. Mounted on one side of the metallic shell there is an LED module 158. This LED module may be mounted in a way similar to that described in the first embodiment. This LED module includes LED's 160 and 162 and LED terminals 164, 166, 168 and 170. Other features of this embodiment are essentially similar to the first embodiment.

It will be appreciated by those skilled in the art that two or more modular jacks may be stacked in vertical relation using the side LED module described herein. It will also be appreciated such single modular jacks with side mounted LED's or two vertical stacks of two or more modular jacks with side mounted LED's may be positioned in horizontal abutting relation. In such horizontal arrangements the LED module will ordinarily be positioned on the opposed outward sides of the jacks rather than between the jacks.

It will be appreciated that a modular jack with an LED has been described in which noise from the LED does not tend to interfere with signals and in which the LED does not tend to be obscured by cables. It will also be appreciated that this modular jack allows the LED to be quickly and easily replaced and, in fact, facilitates field replacement of the LED.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A modular jack comprising:

(a) an insulative housing having:

a substantially open front side;

a rear side;

first and second longitudinal walls positioned such that said second longitudinal wall is positioned over said first longitudinal wall in spaced parallel relation; and a pair of lateral walls interposed in spaced parallel relation between said first and second longitudinal walls to form at least one plug receiving cavity, extending from the substantially open front side of said jack to the rear side, and defining exterior side surfaces of the housing;

(b) conductive elements extending through the housing and into the plug receiving cavity; and (c) an auxiliary insulative housing including:

a light emitting element; and an exterior side surface positioned against, and generally coextensive with, one of said side surfaces of the housing.

2. The modular jack of claim 1 wherein the modular jack and LED are adapted for through mount.

3. The modular jack of claim 1 wherein a conductive shield is interposed between the insulative housing and the light emitting element.

4. The modular jack of claim 3 wherein the light emitting element is a light emitting diode (LED).

5. The modular jack of claim 4, wherein there are a pair of LED's contained in the auxiliary housing.

6. The modular jack of claim 1 wherein the modular jack and auxiliary housing are adapted for surface mount (SMT).

7. The modular jack as recited in claim 6, wherein said conductive elements have surface mount tails that extend in a first direction and said light emitting element has surface mount tails that extend in a second direction generally transverse to said first direction.

8. The modular jack of claim 1, wherein said exterior side surface has an LED receiving recess therein; the light emitting element is an LED positioned in the housing; and wherein said LED receiving recess allows insertion of said LED into said auxiliary housing from said surface.

9. The modular jack of claim 8 wherein the auxiliary housing is adapted to be surface mounted (SMT).

10. The modular jack of claim 8 wherein the auxiliary housing is adapted to be through mounted.

11. The modular jack of claim 8 wherein the auxiliary housing includes a pin which is engageable with the insulative housing.

12. The modular jack of claim 11 wherein the auxiliary housing includes recesses which are engageable by the insulative housing.

13. The modular jack of claim 8 wherein the LED has terminals extending therefrom and said LED receiving recess includes a pair of channels corresponding to said LED terminals.

14. The modular jack of claim 13, wherein the terminals extend from the auxiliary housing.

15. The modular jack of claim 14 wherein said auxiliary housing includes a second LED receiving recess and a second pair of channels; and further comprising a second LED positioned in said second LED receiving recess and having terminals in said second pair of recesses and extending from the auxiliary housing.

16. A modular jack comprising:

(a) an insulative housing having:
a substantially open front side;
a rear side;
first and second longitudinal walls positioned such that said second longitudinal wall is positioned over said first longitudinal wall in spaced parallel relation; and
a pair of lateral walls interposed in spaced parallel relation between said first and second longitudinal walls to form at least one transverse plug receiving cavity extending from the substantially open front side of said jack to the rear side;

(b) conductive elements extending through the housing and into the plug receiving cavity;

(c) a conductive shield superimposed over at least part of the housing and having a retention feature; and (d) an auxiliary insulative housing including a light emitting element and a retention feature corresponding to the retention feature on the conductive shield for securing the auxiliary housing to the conductive shield.

17. The modular jack of claim 16 wherein the modular jack and the auxiliary housing are adapted for surface mount (SMT).

18. The modular jack as recited in claim 16, wherein said retention features of said conductive shield and said auxiliary housing comprise a latch and a latch structure to engage said latch.

19. The modular jack as recited in claim 16, wherein said retention features of said conductive shield and said auxiliary housing comprise a projection and an opening receiving said projection.

20. The modular jack as recited in claim 16, wherein said conductive shield is a one-piece conductive shield.

21. The modular jack of claim 16, wherein said auxiliary housing further comprises a surface adapted to face the insulative housing, said surface having an LED receiving recess therein; the light emitting element is an LED; and said LED receiving recess allows insertion of said LED into said housing from said surface.

22. The modular jack of claim 16 wherein the light emitting element is a light emitting diode (LED).

23. The modular jack of claim 22 wherein there are a pair of LED's contained in the auxiliary housing.

24. The modular jack of claim 16 wherein the modular jack and the auxiliary housing are adapted for through mount.

25. The modular jack of claim 24 wherein the modular jack and the auxiliary housing are adapted for surface mount.

26. A modular jack comprising:

(a) an insulative housing having:
a substantially open front side;
a rear side;
first and second longitudinal walls positioned such that said second longitudinal wall is positioned over said first longitudinal wall in spaced parallel relation; and
a pair of lateral walls interposed in spaced parallel relation between said first and second longitudinal walls to form at least one transverse plug receiving cavity extending from the substantially open front side of said jack to the rear side, and defining exterior side surfaces of the housing;

(b) conductive elements extending through the housing and into the plug receiving cavity;

(c) a conductive shield superimposed over at least one of said exterior side surfaces and having an aperture; and (d) an auxiliary insulative housing including a light emitting element and at least one projection received in said aperture to connect said auxiliary housing to said shield.

27. The modular jack of claim 26 wherein the modular jack and the auxiliary housing are adapted for surface mount (SMT).

28. The modular jack as recited in claim 26, wherein said conductive shield is a one-piece conductive shield.

29. The modular jack of claim 26 wherein the light emitting element is a light emitting diode (LED).

30. The modular jack of claim 29, wherein there are a pair of LED's contained in the auxiliary housing.

31. The modular jack as recited in claim 26, wherein said housing includes an opening, and said at least one projection of said auxiliary housing extends into said opening.

32. The modular jack as recited in claim 31, wherein said at least one projection comprises one projection.

33. A modular jack comprising:

(a) an insulative housing having:
a substantially open front side;
a rear side;
first and second longitudinal walls positioned such that said second longitudinal wall is positioned over said first longitudinal wall in spaced parallel relation; and
a pair of lateral walls interposed in spaced parallel relation between said first and second longitudinal walls to form at least one plug receiving cavity extending from the substantially open front side of said jack to the rear side, and defining exterior side surfaces of the housing;

(b) conductive elements extending through the housing and into the plug receiving cavity; and (c) a light emitting diode (LED) module fixed to the housing and comprising:

an insulative housing having a side surface with an LED receiving recess therein, said side surface positioned against one of said side surfaces of said housing to enclose said LED receiving recess; and an LED positioned in the LED receiving recess of the LED housing.

34. The modular jack as recited in claim 33, wherein said LED comprises a plurality of LEDs.

35. The modular jack as recited in claim 33, wherein said conductive elements have surface mount tails extending in a first direction and said LED has surface mount tails extending in a second direction transverse to said first direction.

36. The modular jack of claim 33 wherein there is a slot in one of the side surfaces of the housing and the LED housing includes at least one pin projecting therefrom which engages said slot.

37. The modular jack of claim 36 wherein a conductive shield is interposed between the LED module and the housing, and there is an aperture in the shield to receive the at least one pin.

38. The modular jack of claim 34 wherein the pin on the LED module abuts the shield to retain the LED module adjacent the lateral wall.

39. The modular jack of claim 34 wherein there are a plurality of hooks on the shield which engage the LED module.

* * * * *